US009278237B2

(12) United States Patent
Cook

(10) Patent No.: US 9,278,237 B2
(45) Date of Patent: Mar. 8, 2016

(54) MOBILE FIRE STATION

(71) Applicant: Carl R. Cook, Mathis, TX (US)

(72) Inventor: Carl R. Cook, Mathis, TX (US)

( * ) Notice: Subject to any disclaimer, the term of this patent is extended or adjusted under 35 U.S.C. 154(b) by 44 days.

(21) Appl. No.: 14/182,070

(22) Filed: Feb. 17, 2014

(65) Prior Publication Data

US 2015/0231430 A1 Aug. 20, 2015

(51) Int. Cl.

| | |
|---|---|
| ***A62C 27/00*** | (2006.01) |
| ***A62C 31/00*** | (2006.01) |
| ***A62C 5/02*** | (2006.01) |
| ***A62C 5/00*** | (2006.01) |
| ***A62C 33/00*** | (2006.01) |

(52) U.S. Cl.

CPC ..... *A62C 27/00* (2013.01); *A62C 5/002* (2013.01); *A62C 5/02* (2013.01); *A62C 31/005* (2013.01); *A62C 33/00* (2013.01)

(58) Field of Classification Search

CPC ..... A62C 5/002; A62C 25/00; A62C 27/00
USPC ..... 169/52, 14; 239/146
See application file for complete search history.

(56) References Cited

U.S. PATENT DOCUMENTS

| | | | | | |
|---|---|---|---|---|---|
| 3,220,482 | A | * | 11/1965 | Eveleth | 169/47 |
| 3,831,849 | A | * | 8/1974 | Studinger | 239/127 |
| 4,170,264 | A | * | 10/1979 | Gibson | 169/24 |
| 4,593,855 | A | | 6/1986 | Forsyth | |
| 4,729,434 | A | | 3/1988 | Rohrbach | |
| 4,875,526 | A | * | 10/1989 | Latino et al. | 169/24 |
| 5,180,108 | A | | 1/1993 | Miyamoto | |
| 5,641,024 | A | * | 6/1997 | Lopez Alvarez | 169/52 |
| 6,142,238 | A | | 11/2000 | Holt et al. | |
| 6,719,214 | B1 | | 4/2004 | Shaffer | |
| 6,973,975 | B1 | | 12/2005 | Adamson et al. | |
| 7,992,648 | B2 | * | 8/2011 | Groonwald | 169/52 |
| 2002/0096339 | A1 | | 7/2002 | Yen | |
| 2008/0271901 | A1 | | 11/2008 | Decker | |
| 2009/0014186 | A1 | | 1/2009 | Collins | |
| 2011/0094761 | A1 | | 4/2011 | Bollens | |
| 2011/0266009 | A1 | | 11/2011 | Liu | |

* cited by examiner

*Primary Examiner* — Arthur O Hall
*Assistant Examiner* — Viet Le
(74) *Attorney, Agent, or Firm* — Dale J. Ream

(57) ABSTRACT

A mobile firefighting station includes a trailer having opposed ends and a platform therebetween. The trailer may include an axle and wheels so as to be mobile. The mobile firefighting station includes firefighting equipment such as a water tank, a foam fire retardant tank, a water hose with nozzle, and a water cannon operatively interconnected and operated by a fluid delivery assembly. The fluid delivery assembly includes a pump to pressurize a fluid stream. An electricity generator is positioned on the platform and electrically connected to components requiring electricity. The apparatus includes a communications module electrically connected to the generator and having a wireless internet connection and a user interface such that tank fluid levels, fuel levels, maintenance records, weather data, and active fire details are selectively communicated to a remote location using the wireless internet connection.

17 Claims, 9 Drawing Sheets

MOBILE FIRE STATION

BACKGROUND OF THE INVENTION

This invention relates generally to fire safety equipment and, more particularly, to a mobile firefighting station that may be moved and stationed near a building or facility at which a fast response with all firefighting assets available would be critical.

Traditionally, a building, manufacturing plant, chemical storage facility, or the like relies on municipal or county fire services to be the first to respond in the unfortunate circumstance of a fire event. Even after having arrived on scene, the fire crew still has to connect their hoses to a water source and deploy other firefighting equipment such as a fire retardant foam spraying apparatus. Unfortunately, by the time fire personnel arrive on scene and get set up, the fire may already be raging out of control. Another recurring problem with emergency response situations is that there is sometimes a lack of real time communication about the fire event and the available firefighting resources currently on-scene with which to battle the fire event.

Various devices have been proposed in the art for bringing fire equipment to a fire scene more quickly and in a better state of readiness. Although assumably effective for their intended purposes, the existing proposals do not adequately couple (1) having crucial firefighting resources already on the site where their presence would be critical for an effective response with (2) having real-time communication of fire event status and status of available firefighting resources currently on scene.

Therefore, it would be desirable to a mobile firefighting station that may be moved and deployed to a location where a fully set up firefighting station would be critical to a successful first response if a fire event were to occur. Further, it would be desirable to have a mobile firefighting station that communicates real-time data regarding the status of on-scene firefighting resources along with fire event status information.

SUMMARY OF THE INVENTION

A mobile firefighting station according to the present invention includes a trailer having opposed ends and a platform therebetween. The trailer may include an axle and wheels so as to be mobile. The mobile firefighting station includes firefighting equipment such as a water tank, a foam fire retardant tank, a water hose with nozzle, and a water cannon operatively interconnected and operated by a fluid delivery assembly. The fluid delivery assembly includes a pump to pressurize a fluid stream. An electricity generator is positioned on the platform and electrically connected to components requiring electricity. The apparatus includes a communications module electrically connected to the generator and having a wireless internet connection and a user interface such that tank fluid levels, fuel levels, maintenance records, weather data, and active fire details are selectively communicated to a remote location using the wireless internet connection.

Therefore, a general object of this invention is to provide a mobile firefighting station that may be deployed in close proximity to a commercial building, chemical storage facility, or other location where having a firefighting unit ready to operate would assist first responders in handling a fire event.

Another object of this invention is to provide a mobile firefighting station, as aforesaid, having an onboard communications module that monitors the status of firefighting resources (such as water and foam) before and during an active fire event.

Still another object of this invention is to provide a mobile firefighting station, as aforesaid, that includes wheels so that the station may be towed to a desired location.

Yet another object of this invention is to provide a mobile firefighting station, as aforesaid, having a water tank, a foam fire retardant tank, a generator for producing electricity, hoses and nozzles, and other firefighting equipment.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A mobile firefighting station according a preferred embodiment of the present invention will now be described in detail with reference to FIGS. 1 to 9 of the accompanying drawings. The mobile firefighting station 10 includes a trailer 20 having a platform 26 upon which firefighting equipment is situated so as to be situated nearby sites most likely to experience a fire or where damage would be most severe if not handled immediately.

Figure 1:
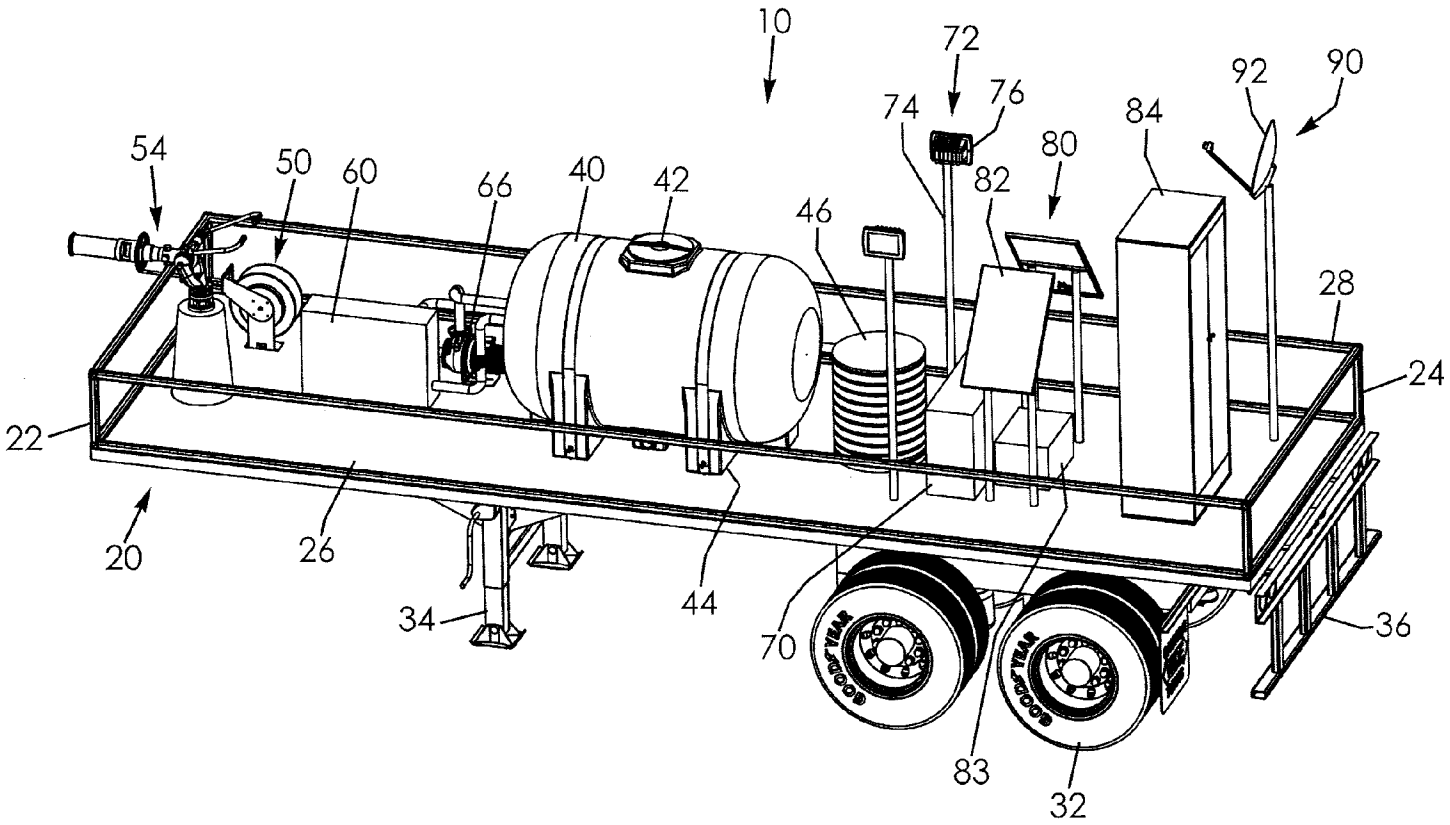
FIG. 1 is a perspective view of a mobile firefighting station according to a preferred embodiment of the present invention.
Figure 2:
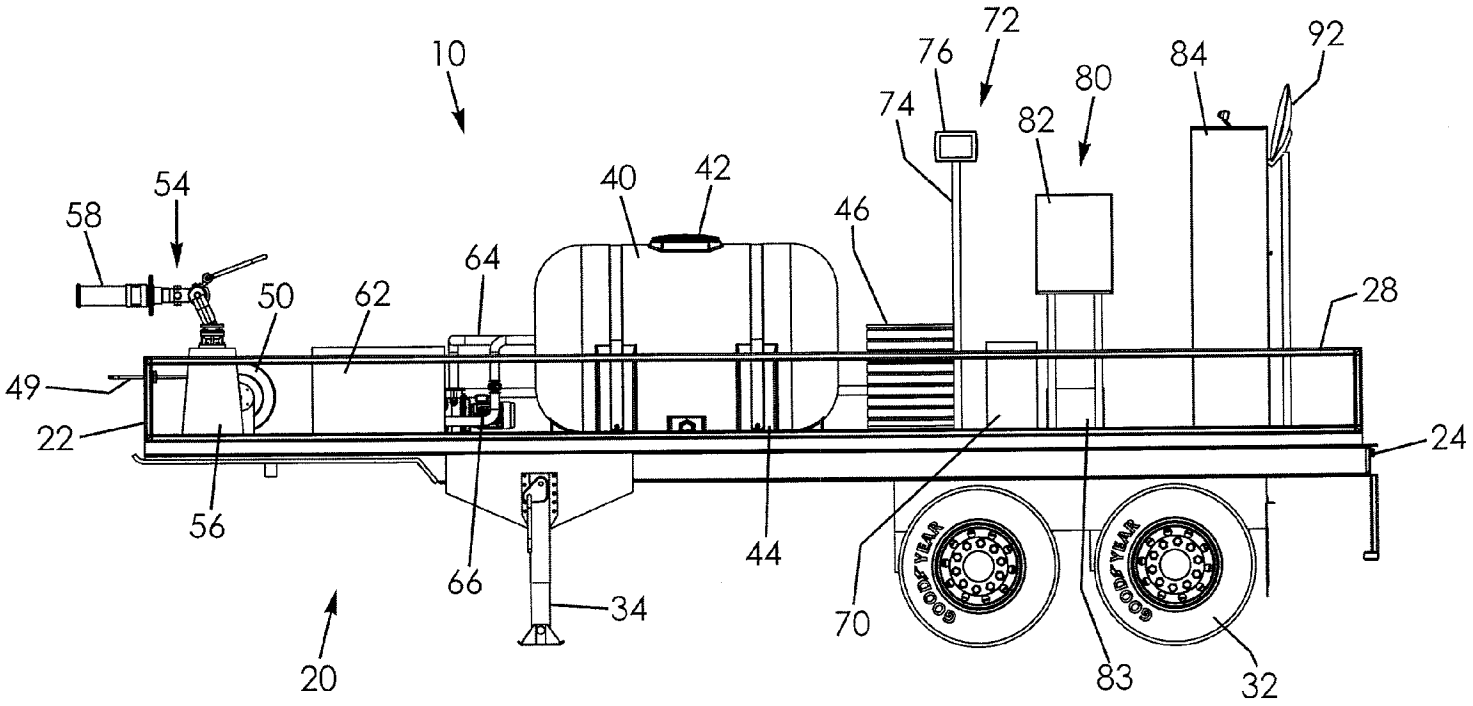
FIG. 2 is a left side view of the mobile firefighting station as in FIG. 1.
Figure 3:
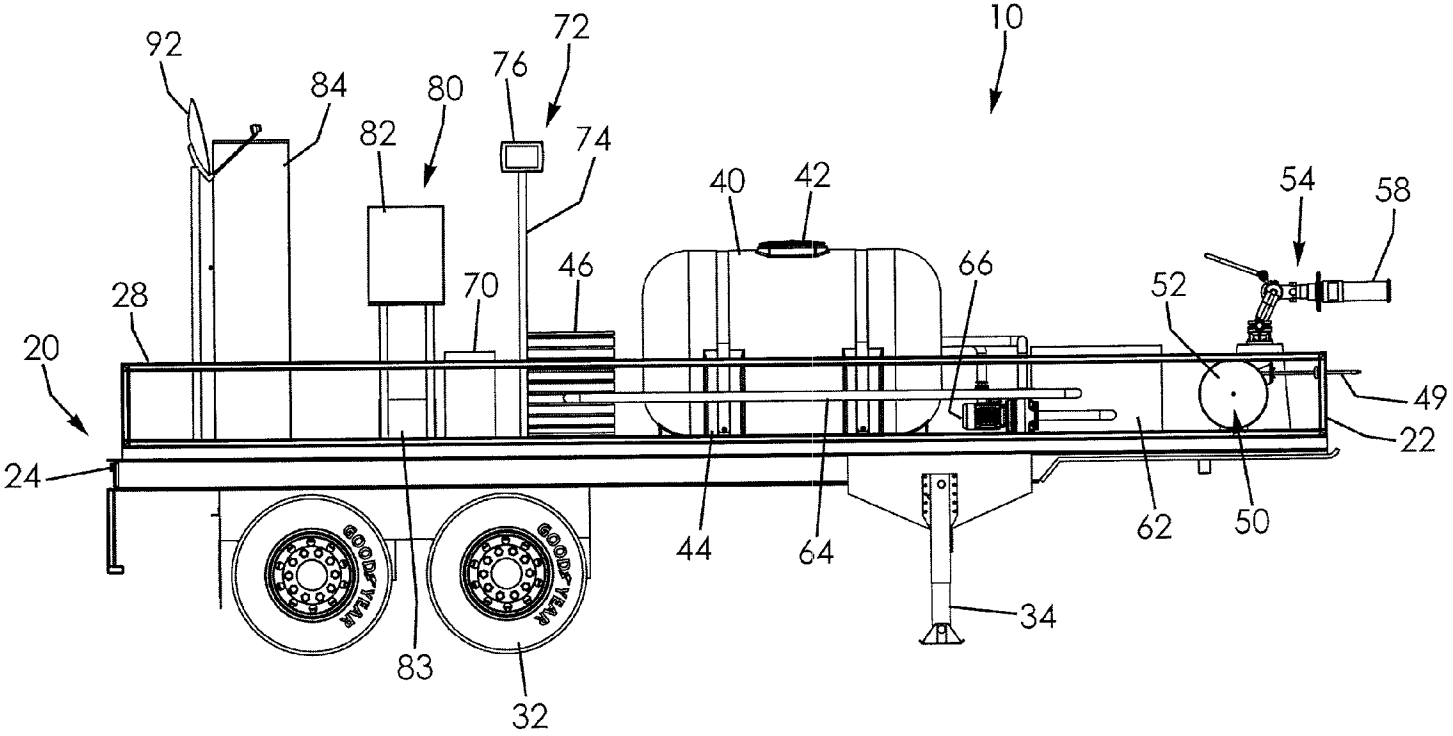
FIG. 3 is a right side view of the mobile firefighting station as in FIG. 1.
Figure 4:
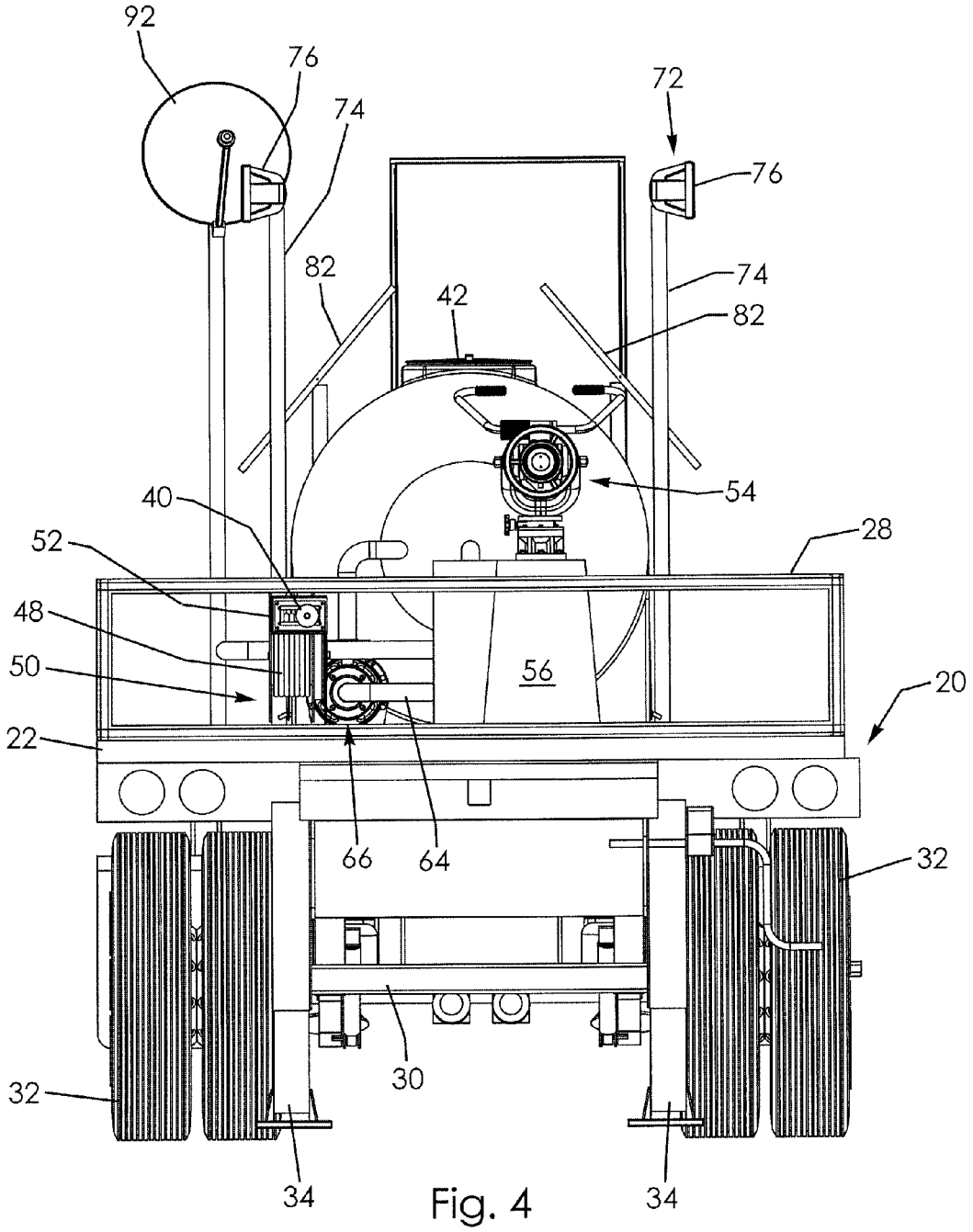
FIG. 4 is a front end view of the mobile firefighting station as in FIG. 1.
Figure 5:
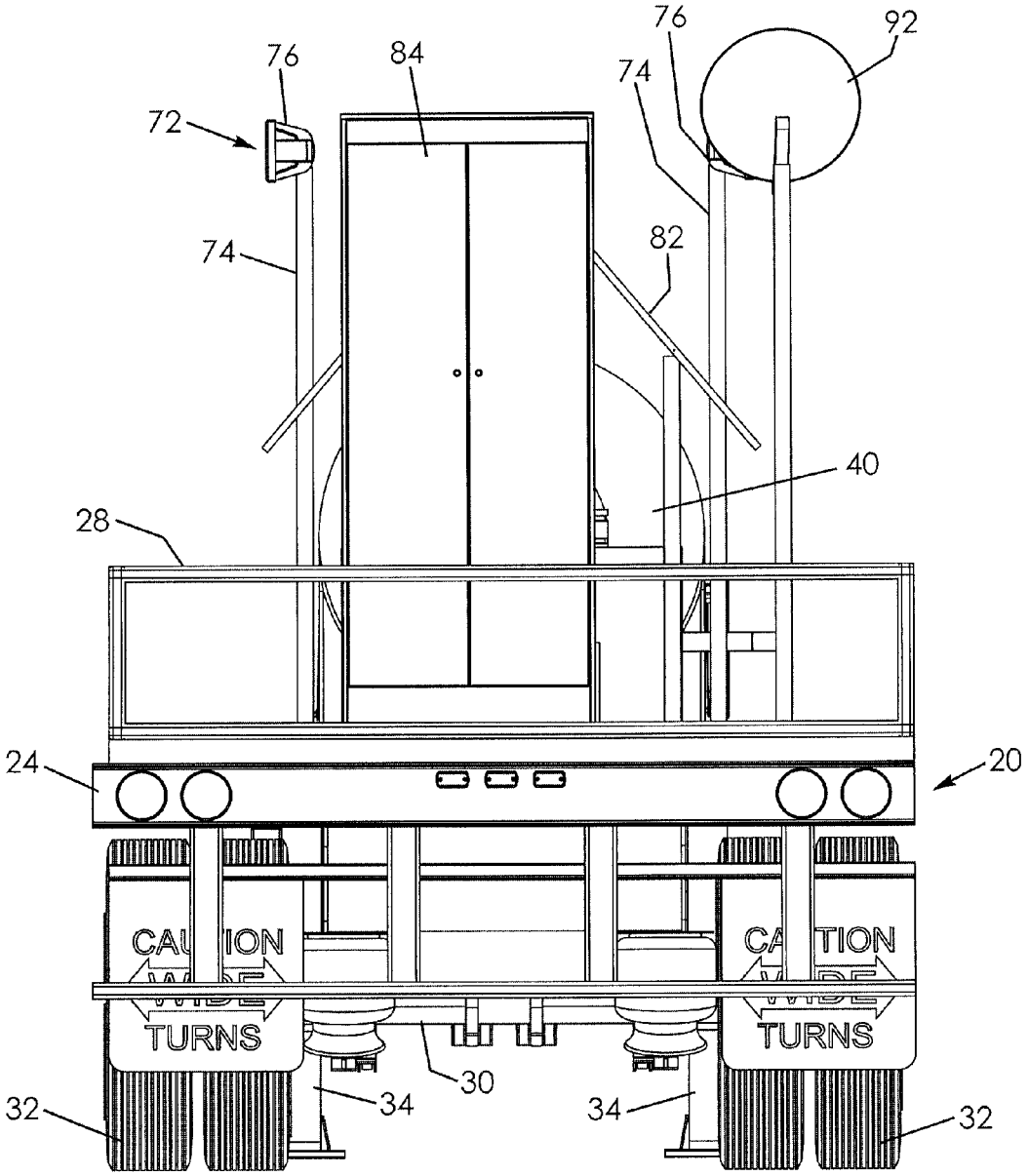
FIG. 5 is a rear end view of the mobile firefighting station as in FIG. 1.

The mobile firefighting station 10 includes a trailer 20 of a type that may be pulled behind a truck. For instance, the trailer 20 may be a flatbed trailer that may be coupled to the cab of a semi-truck or, in some embodiments, to the trailer hitch of a pickup truck. The trailer 20 includes first 22 and second 24 ends and has a flat platform 26 extending entirely between the ends (FIG. 1). In one embodiment, the trailer 20 may include one or more guard rails 28 extending about the peripheral edge of the platform 26, the guard rail 28 being configured to provide stability and safety to a user standing or walking on the platform, as will be described later. In another embodiment (not shown), the platform 26 may be supported on outriggers adjacent both the first end 22 and second 24 end and no axle or wheels are included at all.

The trailer 20 may include at least one axle 30 operatively coupled to a bottom side of the platform 26. The axle 30 has an elongate configuration having opposed ends, each end being configured to receive a wheel/tire combination 32. In some embodiments, dual axles and respective wheels may be included to provide additional weight bearing properties to the platform 26 and to enable the trailer 20 to be positioned more easily in harsh ground conditions. The axle 30 is positioned adjacent the second end 24 (i.e. the rear end) of the trailer 20. The trailer 20 may include a pair of outriggers 34 coupled the bottom of the platform 26 and extending downwardly therefrom. Each outrigger 34 is a length adjustable shaft that enables a user to manually level the trailer 20 and platform 26 when positioned on uneven ground. In some embodiments, more than a pair of outriggers 34 may be utilized.

A large water tank 40 is mounted atop the platform 26 and preferably positioned in a middle position thereon (FIG. 1). Specifically, the water tank 40 may be a 500, 750, or 1,000 gallon tank. The water tank 40 may be constructed of polyurethane or fiberglass although other materials would also work. The water tank 40 includes a lid 42 that, when in an open configuration, provides access to the tank interior chamber. Accordingly, the water tank 40 may be refilled with water from a water truck or with a hose and pump connected to a water source such as a lake.

In addition, a tank mounting framework 44 may be positioned atop the platform 26 and configured to cradle the water tank 40. In use, a full water tank 40 may be transported to the site where the trailer 20 is situated and the water tank 40 may be deposited onto the framework 44, such as with a forklift or small crane, as the size and weight may dictate.

A foam fire retardant tank 46 is also positioned atop the platform 26 and may be positioned adjacent the main water tank 40. Fire retardant foam is used in firefighting to cool a fire, to coat the fuel that is feeding a fire and, as a result, prevent contact with oxygen. The foam fire retardant tank 46 may include an inlet port for refilling the tank.

The mobile firefighting station 10 includes at least one water hose 48 having a first end in fluid communication with the water tank 40 and the foam fire retardant tank 46. The hose 48 includes a second end to which a firefighting nozzle 49 may be attached. Various sizes of water hose 48 are suitable with the present invention.

A water cannon 54 may be situated on the platform 26, the water cannon 54 having a base 56 that is rotatable 360 degrees and that may be pivoted up and down. The water cannon 54 may include a high pressure nozzle configured to enhance the distance and accuracy of a water flow. Handles that enable a user to rotate and pivot the water cannon 54 may also be coupled to the base 56. The water cannon 54 may be coupled to the water hose 48 or directly to the water tank 40.

The mobile firefighting station 10 includes a fluid delivery assembly 60 having a control box 62, a piping network 64, valves, and controls. More particularly, the delivery assembly 60 includes conduit that extends between various components such as the water tank 40, the foam fire retardant tank 46, water cannon 54, and water hose 48. The conduit is in some instances not shown in the drawings let the drawings become unclear. In some embodiments, the conduit may be run underneath the trailer and not be visible or be in the way atop the platform 26. It is understood that appropriate valves may be situated in the conduit adjacent respective tanks or water output devices so as to regulate which components are used. For instance, the piping network 64 with its valves and controls will enable the water and foam to be delivered independently or in combination as may be helpful to control a fire. Automatic controls may be situated in the control box 62.

An electricity generator 70 is positioned on the platform 26 and is electrically connected to the control box 62, a water pump 66, and a communications module 90 as described below. The generator 70 may utilize diesel or gasoline as fuel and generates electrical current when running. In use, the generator 70 enables the mobile firefighting station 10 to power all of its components without connection to any other electrical source.

A water pump 66 is in fluid communication with the water tank 40 such as by connection to the piping network 64. The water pump 66 may be electrically connected to the generator 70 or control box 62. It is understood that the water pump 66 is configured to boost the water pressure of a water stream from the water tank 40 to the water hose 48 or other water spraying outlet.

The mobile firefighting station 10 includes a communications module 90 electrically connected to the generator 70 as its source of electricity. The communications module 90 may include circuitry or programming configured to make and maintain an internet connection. More particularly, the communications module 90 may include a network server having a processor 94, data structures and programming instructions stored in memory 96.

The communications module 90 may include a user interface 98 such as a keyboard or touch screen (input) and display (output). The communications module 90 is configured to transmit data to a remote location such as a company control center or a fire station. Sensors may be associated with the water tank 40, foam fire retardant tank 46, generator 70, and other components that are configured to collect data such as water usage, volume remaining, fuel levels, and the like. For instance, the control box 62 may include a water meter and a foam meter associated with the water tank and foam fire retardant tank, respectively. The communications module 90 may be configured to automatically send updates through the internet. Alternatively, a user may enter respective data into the user interface 98 and transmit the same through the internet. Further, the communications module 90 may be used to transmit and receive data indicative of maintenance records, weather data, active fire status, and the like.

The communications module 90 may include a satellite dish 92 configured to make and maintain a wireless internet connection. The dish 92 and communications module 90 may also be configured to make mobile phone calls, for instance, a satellite phone.

Figure 6A:
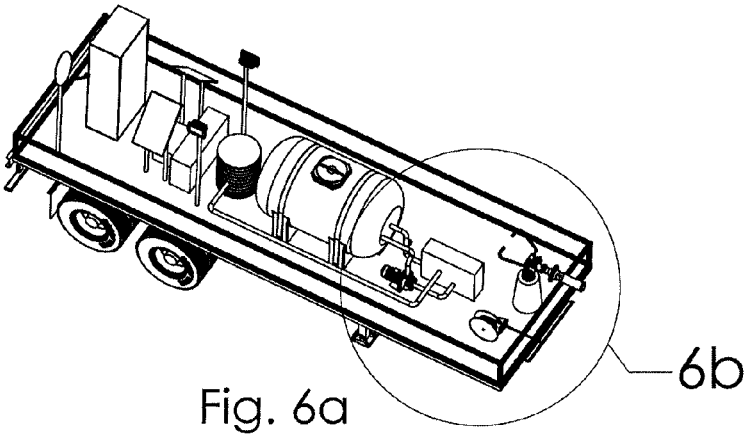
FIG. 6*a* is an elevated perspective view of the mobile firefighting station as in FIG. 1.
Figure 6B:
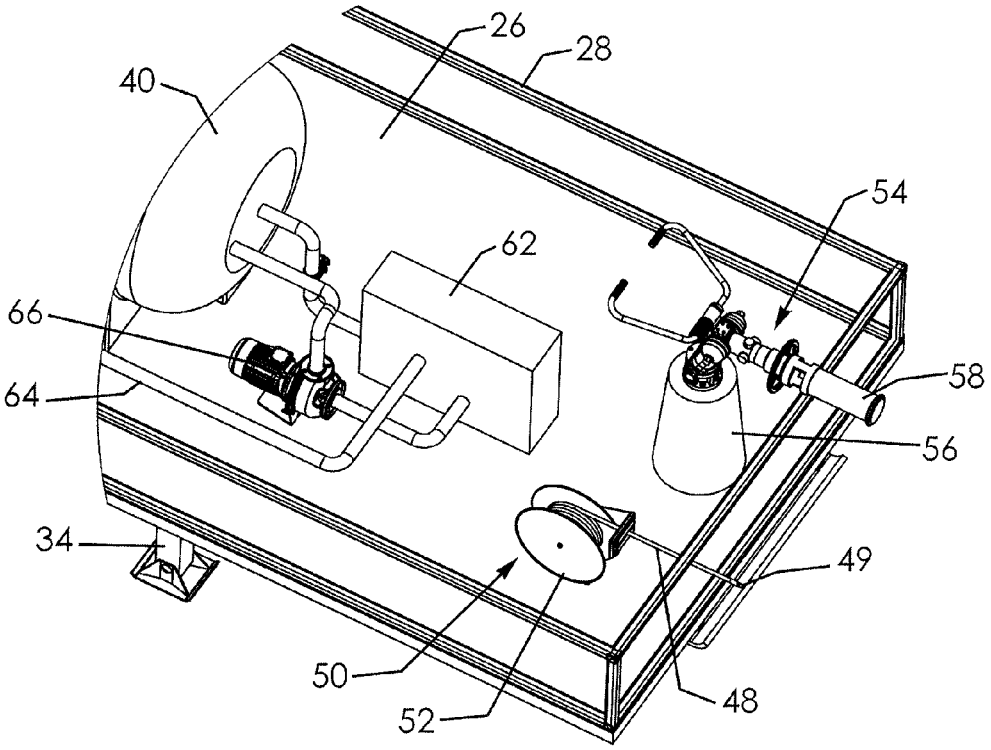
FIG. 6*b* is an isolated view on an enlarged scale taken from FIG. 6*a;*
Figure 7A:
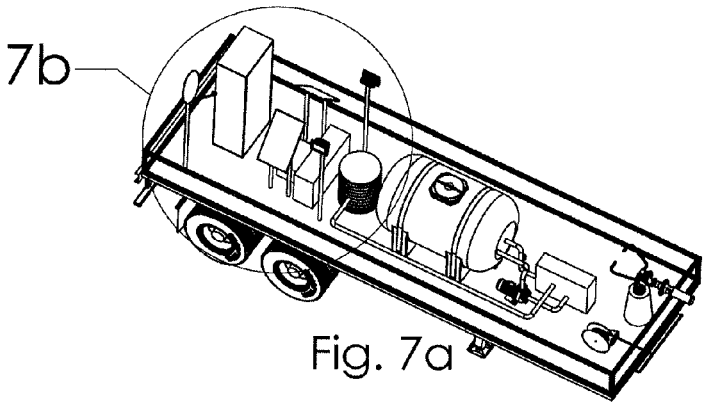
FIG. 7*a* is another elevated perspective view of the mobile firefighting station as in FIG. 1.
Figure 7B:
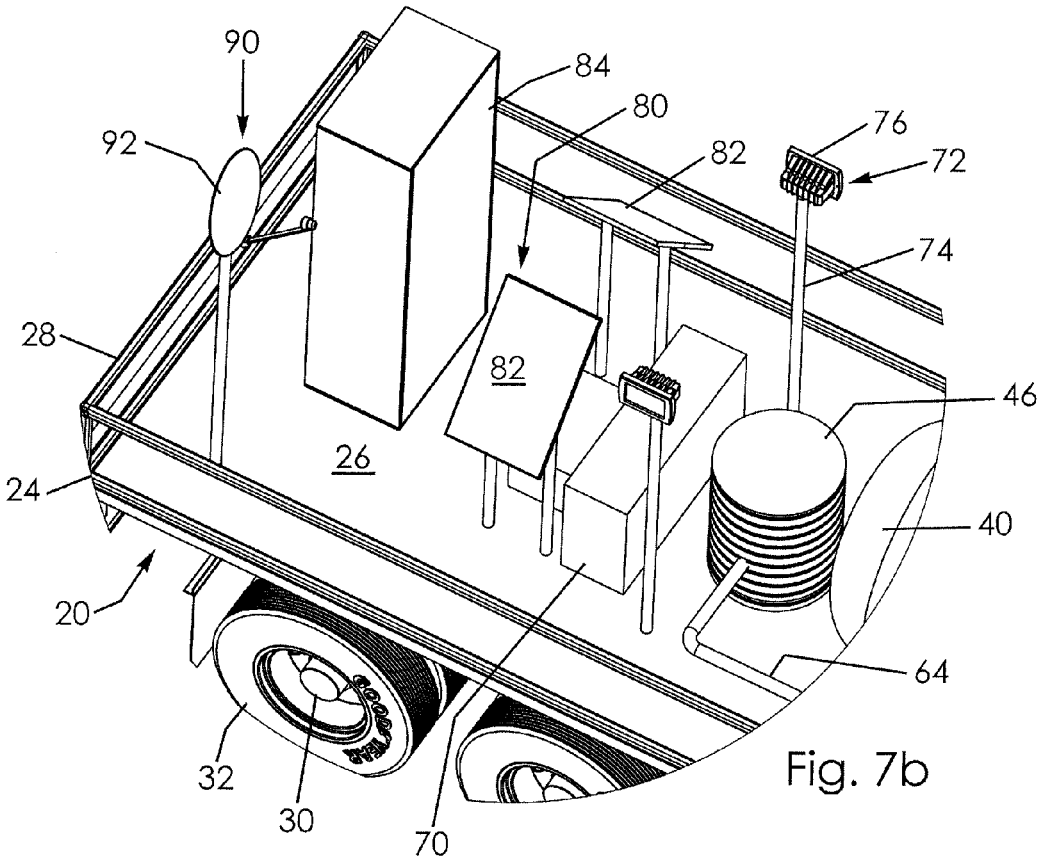
FIG. 7*b* is an isolated view on an enlarged scale taken from FIG. 7*a;*
Figure 8A:
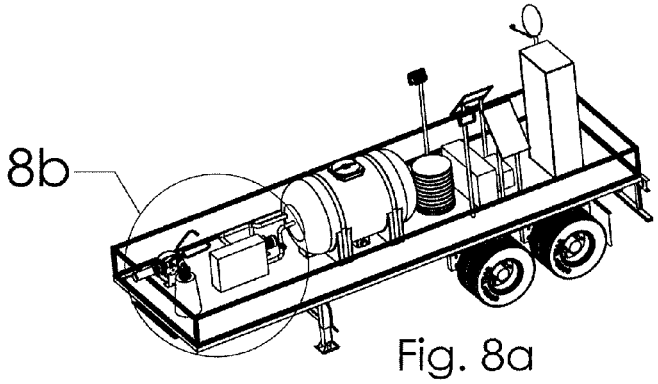
FIG. 8*a* is another elevated perspective view of the mobile firefighting station as in FIG. 1.
Figure 8B:
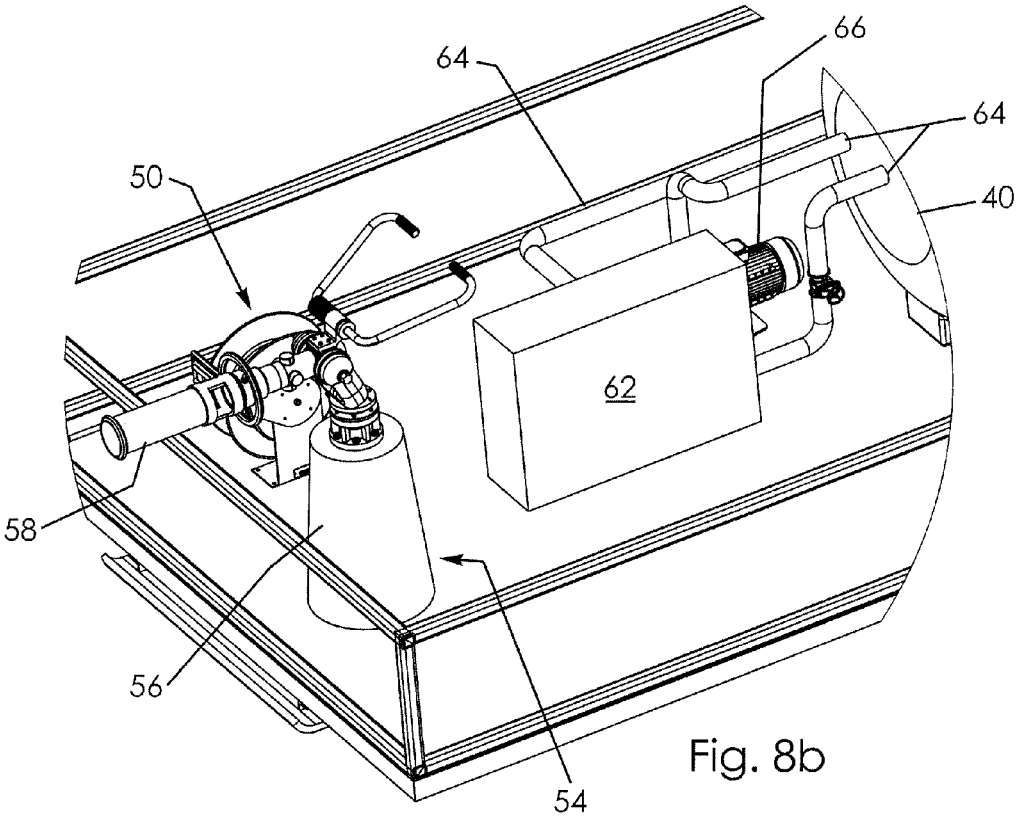
FIG. 8*b* is an isolated view on an enlarged scale taken from FIG. 8*a*.
Figure 9:
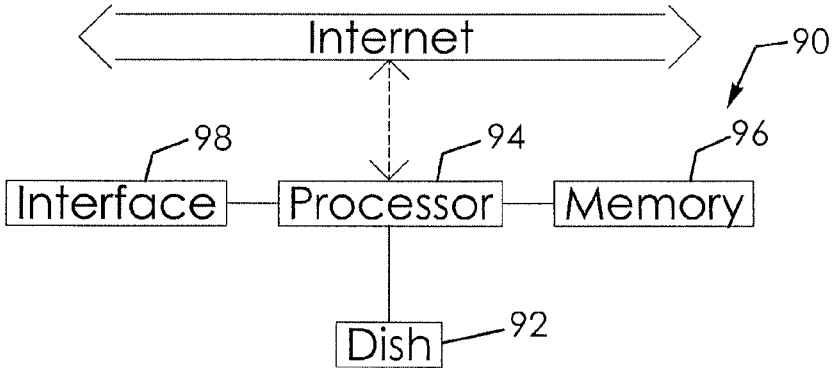
FIG. 9 is a block diagram illustrating components of a communications module according to the present invention.

In one embodiment, the mobile firefighting station 10 includes a hose reel 50 situated on the platform 26 (FIG. 6*b*). The hose reel 50 includes a rotating member 52 configured to selectively wind the water hose 48 onto itself. For instance, the rotating member 52 may be moved between a stowed configuration in which the water hose 48 is substantially wound onto itself about the rotating member 52 and a deployed configuration in which the water hose 48 is extended away from the hose reel 50. The hose reel 50 may include a handle that enables a user to rotate the rotating member 52. In an alternative embodiment, the hose reel 50 may include an electric motor electrically connected to the generator 70, the motor causing the rotating member 52 to wind automatically when energized.

The mobile firefighting station 10 includes a lighting assembly 72 that enables the platform 26 and areas adjacent the platform 26 to be adequately lighted at night. More particularly, the lighting assembly 72 includes a plurality of adjustable length poles 74 ("light poles"). Each pole 74 is mounted to the platform 26, either permanently or removably, and extends upwardly therefrom. Each pole 74 may have a telescopic construction that includes a multitude of slidable sleeves or may include a pair of concentric tubular sections that are held at a desired position by a pin, bolt, latch, or other fastener. In any case, each pole 74 is movable between a retracted configuration and an extended configuration.

The lighting assembly 72 includes a plurality of light sources 76 such as fluorescent, incandescent, or LED light bulbs. A respective light source 76 is coupled to an upper end of each respective light pole 74, is electrically connected to the generator 70 or other power source, and may be selectively energized so as to illuminate the platform 26 and areas adjacent to the platform 26.

In one embodiment, the mobile firefighting station 10 includes a solar energy collection assembly 80. The solar energy collection assembly 80 includes at least one solar panel 82 configured to collect solar light rays and to convert collected solar energy into electricity in a traditional manner. The solar energy collection assembly 80 may, in respective embodiments, be electrically connected to the generator 70 or directly to the communications module 90 in a manner so as to be a backup in case the generator 70 failed to produce a needed amount of electricity. In addition, the solar energy collection assembly 80 may include one or more batteries configured to receive and store electrical current converted from collected solar energy by the solar energy collection assembly 80. The storage batteries (not shown) may be housed in a storage housing 83.

The mobile firefighting station 10 may include a ladder 36 removably coupled to the trailer 20 (FIG. 1). It is also understood that one or more traditional fire extinguishers (not shown) may be strategically positioned about the platform 26 in case a firefighter is battling a fire very near the trailer 20 or needs to abandon the trailer 20 altogether.

A gear storage container 84 is mounted atop the platform 26 and defines an interior area configured to store firefighting gear. The gear storage container 84 (also known as a bunker gear locker) may house gear such as oxygen tanks and masks, first aid supplies, personal water tanks, and the like.

In use, the entire mobile firefighting station 10 may be positioned near a building or facility to be protected from fire or for which an immediate response to a fire emergency is critical. Specifically, the trailer 20 may be towed to the desired location and then detached. The communications module 90 may be initiated to connect to a remote server with an internet connection. Sensors providing automatic readings may be transmitted automatically or entered manually as described above. In the event a fire event is detected, emergency personnel may be deployed to the mobile firefighting station and are immediately and independently able to begin firefighting efforts, such as by deploying foam from the foam fire retardant tank 40, water through the water cannon 54 or the like. Other firefighting gear is also immediately available in the gear storage container 84.

It is understood that while certain forms of this invention have been illustrated and described, it is not limited thereto except insofar as such limitations are included in the following claims and allowable functional equivalents thereof.

The invention claimed is:

1. A mobile firefighting station, comprising:

a trailer having opposed first and second ends and a platform extending between said first and said second end;

an axle operatively coupled to a bottom side of said platform adjacent said second end thereof, said axle having opposed ends configured to operatively receive a pair of wheels, respectively, such that said trailer is selectively movable by rolling on said pair of wheels;

a water tank positioned atop said platform;

a foam fire retardant tank positioned atop said platform;

a water hose having a first end operatively connected to said water tank and an opposed second end;

a firefighting nozzle connected to said second end of said water hose and configured to selectively spray water;

a water cannon situated on said platform and having a rotatable base configured to rotate 360 degrees and to pivot up and down, said water cannon being operatively connected to said water tank;

a generator positioned atop said platform and configured to generate electricity when activated;

a fluid delivery assembly having a piping network, valves, and controls operatively interconnecting said water tank, said foam fire retardant tank, said water hose, said water cannon, and said water pump;

a water pump operatively connected to said generator and to said water hose and configured to boost water pressure therein; and a communications module electrically connected to said generator and having a wireless internet connection and a user interface such that tank fluid levels, fuel levels, maintenance records, weather data, and active fire details are selectively communicated to a remote location using said wireless internet connection.

2. The mobile firefighting station as in claim 1, wherein said communications module includes a satellite dish configured to maintain internet and cellular telephone communications.

3. The mobile firefighting station as in claim 1, further comprising a hose reel situated on said platform and having a rotating member configured to selectively wind said water hose, said rotating member being movable between a stowed configuration at which said water hose is substantially wound about said rotating member and a deployed configuration at which said water hose is substantially extended away from said rotating member.

4. The mobile firefighting station as in claim 1, further comprising a lighting assembly electrically connected to said generator, said lighting assembly having a plurality of length adjustable poles and a plurality of lighting sources mounted to said plurality of poles, respectively, that are selectively energized to illuminate said platform and areas adjacent said platform.

5. The mobile firefighting station as in claim 4, wherein at least one of said plurality of said poles is located adjacent said first and said second ends of said platform, respectively.

6. The mobile firefighting station as in claim 1, further comprising a solar collection assembly configured to collect solar energy and convert said collected solar energy into electricity, said solar collection assembly being electrically connected to said generator and configured as a back-up source of electricity.

7. The mobile firefighting station as in claim 1, further comprising a solar collection assembly configured to collect solar energy and convert said collected solar energy into electricity, said solar collection assembly being electrically connected to said communications module.

8. The mobile firefighting station as in claim 7, wherein said solar collection assembly includes at least one battery configured to store the electricity converted from the collected solar energy.

9. The mobile firefighting station as in claim 1, wherein said fluid delivery assembly includes a control box having a water meter operatively connected to said water tank and a foam meter operatively connected to said foam fire retardant tank for monitoring usage of water and foam, respectively.

10. The mobile firefighting station as in claim 3, wherein said rotating member of said hose reel is electrically connected to said generator such that said rotating member is automatically rotated when energized.

11. The mobile firefighting station as in claim 1, further comprising a ladder selectively coupled to said second end of said platform.

12. The mobile firefighting station as in claim 1, further comprising at least a pair of outriggers extending downwardly from a bottom surface of said platform, each outrigger being length adjustable to selectively maintain said platform in a level orientation.

13. The mobile firefighting station as in claim 1, further comprising a gear storage container situated atop said platform.

14. The mobile firefighting station as in claim 1, further comprising a gear storage container situated atop said platform.

15. The mobile firefighting station as in claim 8, further comprising:

a hose reel situated on said platform and having a rotating member configured to selectively wind said water hose, said rotating member being movable between a stowed configuration at which said water hose is substantially wound about said rotating member and a deployed configuration at which said water hose is substantially extended away from said rotating member; and a lighting assembly electrically connected to said generator, said lighting assembly having a plurality of length adjustable poles and a plurality of lighting sources mounted to said plurality of poles, respectively, that are selectively energized to illuminate said platform and areas adjacent said platform.

16. The mobile firefighting station as in claim 15, further comprising a gear storage container situated atop said platform.

17. The mobile firefighting station as in claim 16, further comprising a ladder selectively coupled to said second end of said platform.

* * * * *